US012421644B2

(12) United States Patent
Di Maggio et al.

(10) Patent No.: US 12,421,644 B2
(45) Date of Patent: Sep. 23, 2025

(54) WASHING MACHINE AND METHOD FOR OPERATING A WASHING MACHINE

(71) Applicant: E.G.O. Elektro-Geraetebau GmbH, Oberderdingen (DE)

(72) Inventors: Antonio Di Maggio, Schwaigern (DE); Uwe Schaumann, Oberderdingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 187 days.

(21) Appl. No.: 18/352,397

(22) Filed: Jul. 14, 2023

(65) Prior Publication Data

US 2024/0026590 A1 Jan. 25, 2024

(30) Foreign Application Priority Data

Jul. 21, 2022 (DE) ..... 10 2022 207 456.4

(51) Int. Cl.
*D06F 35/00* (2006.01)
*D06F 39/06* (2006.01)
(Continued)

(52) U.S. Cl.
CPC ..... *D06F 35/006* (2013.01); *D06F 39/06* (2013.01); *D06F 39/085* (2013.01);
(Continued)

(58) Field of Classification Search
CPC ..... D06F 35/006; D06F 39/06; D06F 39/083; D06F 39/085; D06F 39/088; D06F 2103/14; D06F 2105/06
See application file for complete search history.

(56) References Cited

U.S. PATENT DOCUMENTS 3,070,984 A * 1/1963 Thomas ..... D06F 39/06 68/17 R
11,739,455 B2 * 8/2023 Kehl ..... D06F 37/26 68/12.14
(Continued)

FOREIGN PATENT DOCUMENTS

CN 113564880 A 10/2021
DE 1911523 U 3/1965
(Continued)

OTHER PUBLICATIONS

European Patent Office, Extended European Search Report received for Application No. 23183559, dated Dec. 5, 2023, 10 pages, Germany.
(Continued)

*Primary Examiner* — Joseph L. Perrin
(74) *Attorney, Agent, or Firm* — ALSTON & BIRD LLP

(57) ABSTRACT

A washing machine has a drum for washing laundry therein, and a drum-receiving container in which the drum is arranged rotatably about an axis of rotation and at the bottom of which is provided a container drain. A valve is arranged at the container drain on the drum-receiving container, which valve seals the drum-receiving container at the bottom in watertight and airtight manner. In the upper region of the drum-receiving container is provided an air inlet which is closable in airtight manner by way of an air inlet valve and by way of two oppositely arranged nonreturn valves.

13 Claims, 1 Drawing Sheet

(51) Int. Cl.
*D06F 39/08* (2006.01)
*D06F 103/14* (2020.01)
*D06F 105/06* (2020.01)

(52) U.S. Cl.
CPC ..... *D06F 39/088* (2013.01); *D06F 39/083* (2013.01); *D06F 2103/14* (2020.02); *D06F 2105/06* (2020.02)

(56) References Cited

U.S. PATENT DOCUMENTS

| | | | | |
|---|---|---|---|---|
| 2004/0261195 | A1 | 12/2004 | Ghosh et al. | |
| 2005/0011234 | A1 | 1/2005 | Kim et al. | |
| 2010/0300154 | A1* | 12/2010 | Nakamura | D06F 39/083 68/13 R |
| 2011/0048078 | A1* | 3/2011 | Tobi | D06F 39/08 68/12.13 |
| 2014/0283312 | A1 | 9/2014 | Bocchino et al. | |
| 2018/0298538 | A1 | 10/2018 | Nishiura et al. | |
| 2022/0145517 | A1 | 5/2022 | Schaumann et al. | |

FOREIGN PATENT DOCUMENTS

| | | | |
|---|---|---|---|
| DE | 102014210626 | A1 | 12/2015 |
| DE | 102016204347 | A1 | 9/2017 |
| EP | 3219841 | A1 | 9/2017 |
| EP | 3995617 | A1 | 5/2022 |
| WO | WO 2005/003268 | A1 | 1/2005 |

OTHER PUBLICATIONS

German Patent and Trademark Office, Office Action received for Application No. 102022207456.4, dated May 26, 2023, 7 pages, Germany.

* cited by examiner

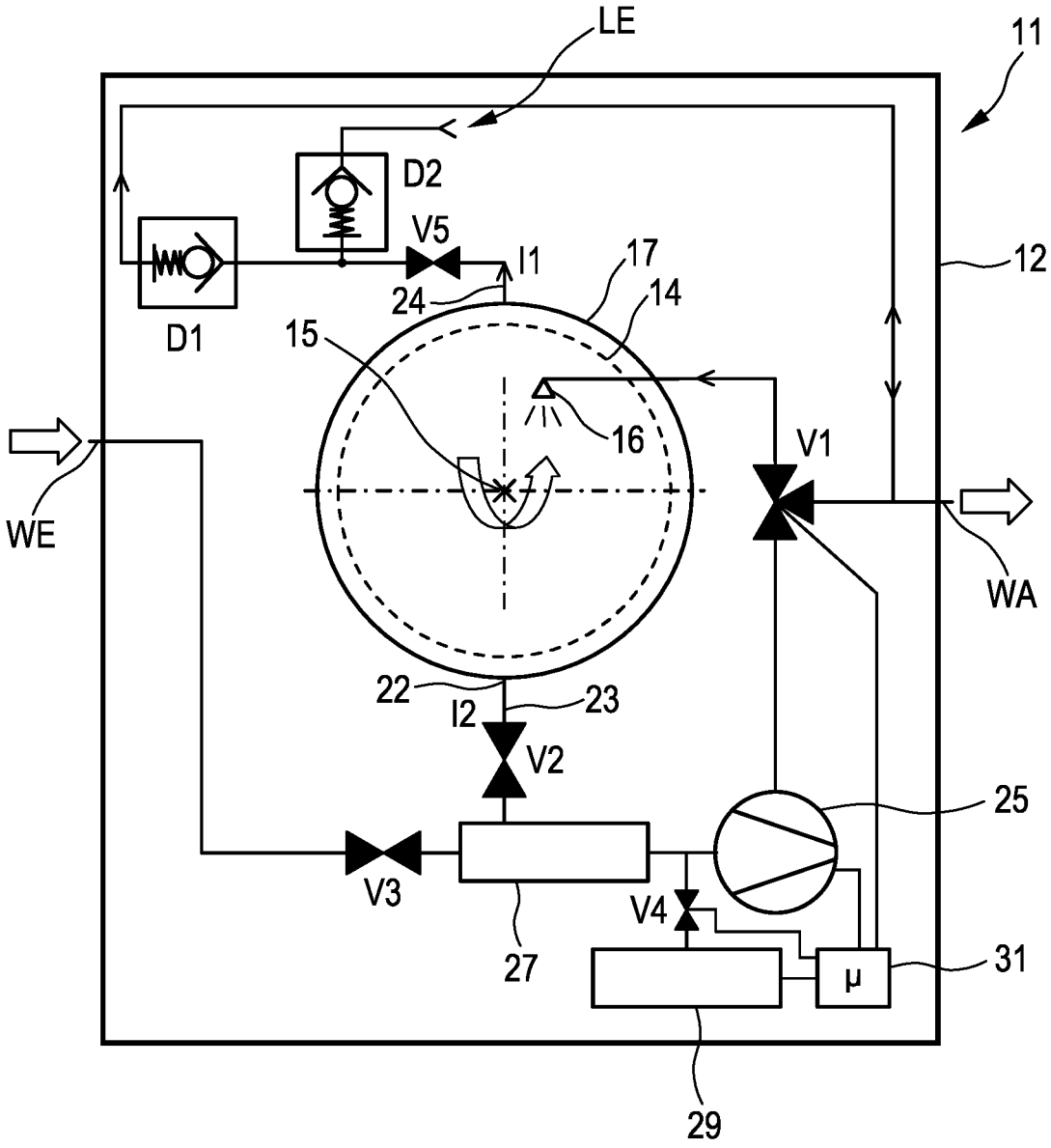
LE
11
D2
V5
I1
17
12
24
14
D1
15
16
V1
WE
WA
22
23
I2
V2
25
V3
V4
27
μ
31
29

WASHING MACHINE AND METHOD FOR OPERATING A WASHING MACHINE

CROSS-REFERENCE TO RELATED APPLICATIONS

This application claims priority to German Application No. 10 2022 207 456.4, filed Jul. 21, 2022, the contents of which are hereby incorporated herein in its entirety by reference.

FIELD OF APPLICATION AND PRIOR ART

The invention relates to a washing machine and to a method for operating such a washing machine.

US 2004/261195 A1 discloses a washing machine with what is known as a recirculation system, in which water is introduced not from the outside into a drum arranged in a drum-receiving container by partially flooding the drum receiving container, but instead directly into the drum through an axis of rotation. A lower water level can thus be provided in the lower region of the drum-receiving container. This can reduce the formation of suds.

EP 3 219 841 A1 discloses a washing machine which suffers the problem of suds being formed during the spinning of a drum. This results in a further problem for pumping out washing liquor which contains very many suds. This can lead to a reduction in the drive power of a pump in the washing machine for pumping out and in the efficiency of the pump. In addition, it is very difficult to pump out the suds which disrupts the progress of the washing.

OBJECT AND ACHIEVEMENT THEREOF

The object of the present invention is to provide a washing machine as stated above and a method for the operation thereof as stated above, with which prior art problems can be solved and which make it in particular possible to efficiently operate a washing machine and preferably to reduce the formation of suds during a washing process or during spinning.

Said object is achieved by a washing machine having the features of claim 1 and by a method for the operation thereof having the features of claim 12 and claim 13. Advantageous and preferred embodiments of the invention are the subject matter of further claims and are explained in greater detail in the following. Some of the features are described only for the washing machine or for the method. They are, however, intended to apply by themselves and independently of one another both to such a washing machine and to such a method. The wording of the claims is incorporated by express reference into the content of the description.

The washing machine has a drum for washing laundry therein, a drum-receiving container in which the drum is arranged rotatably about an axis of rotation, and a water routing system. The water routing system has a water inlet from an external water supply into the washing machine, water lines and valves, a water outlet from the washing machine, an input device for water into the drum, at least one container drain at the bottom of the drum-receiving container, a pump which is connected by way of water lines, on the one hand, to the container outlet and, on the other hand, to the input device, and optionally also a filter for filtering water flowing through it. The washing machine moreover has a washing machine controller which is connected to the pump and advantageously to all the controllable functional units of the washing machine.

According to the invention, a valve is arranged at the container drain on the drum-receiving container, which valve seals the drum-receiving container in watertight and airtight manner, in particular water may or may not be drained off through it from the bottom of the drum-receiving container. In the upper region of the drum-receiving container is provided an air inlet which is closable in airtight manner by way of an air inlet valve. Alternatively or additionally, one or more nonreturn valves, optionally with different conducting directions, may also be provided here.

The air inlet in the upper region of the drum-receiving container advantageously has a cross-section which is greater than the sum of all the cross-sections of the container drains at the bottom of the drum-receiving container. Accordingly, suds can, for example be evacuated to the air inlet and, possibly, even be entirely removed from the washing machine.

The air inlet may preferably be arranged in the upper third of the drum-receiving container, preferably in the upper fifth. It may particularly preferably be arranged at the uppermost point of the drum-receiving container.

At least one nonreturn valve is advantageously provided in or at the upper region of the drum-receiving container or at the stated air inlet. Such a nonreturn valve may be configured to let air, water or suds out of the drum-receiving container, in particular through via the water outlet. The conducting direction of the nonreturn valve is then out of the drum-receiving container. Such suds are then no longer troublesome, in particular if they can be removed from the washing machine to the water outlet. Discharging air may also be advantageous, in particular in order to avoid "pumping" within the washing machine due to rapidly changing pressure conditions. These may arise when the drum is set in motion during rapid rotation, for example during spinning, due to an imbalance.

An alternative or possibly further nonreturn valve may be configured to allow air to pass therethrough into the drum-receiving container. Its conducting direction is then into the drum-receiving container. Preferably, precisely two nonreturn valves, which are particularly advantageously oppositely configured and arranged, are provided in the upper region of the drum-receiving container. They thus have opposing conducting directions.

A cross-sectional constriction within a nonreturn valve or nonreturn throttle valve can advantageously have a fixed setting or be controllable. If the flow diameter or cross-section is variable, the nonreturn valve is controllable or adjustable. In controlled nonreturn valves or nonreturn throttle valves, the cross-section is determined by a reference variable. A combination of air inlet nonreturn valve and throttle may be provided here.

If only a static reduction in flow diameter is involved, the nonreturn throttle valve is described as uncontrolled. Optimum adaptation to the particular application is achieved by varying the different sizes (e.g. length and diameter) of the throttle nonreturn valve.

In one development of the invention, a flow cross-sectional area of the two nonreturn valves may differ. Provision may be made for a flow cross-sectional area of a first nonreturn valve with a conducting direction out of the drum-receiving container to be greater than a flow cross-sectional area of a second nonreturn valve with a conducting direction into the drum-receiving container.

In a method for operating an above-described washing machine, a valve at the at least one container drain out of the drum-receiving container is opened for pumping water out of the drum-receiving container. Advantageously, the air inlet valve in the upper region of the drum-receiving container is additionally opened, which can also be effected by appropriately configured nonreturn valves or by the nonreturn valve with a conducting direction into the drum-receiving container.

A valve at the at least one container drain may be entirely or at least 50% closed in order to reduce suds in the drum, which would be troublesome for and negatively impact the washing process. This prevents the suds from spreading further in the system or in the water routing system, in particular not in the direction of the pump. Stable pump operation can thus be continued.

These and further features are revealed in the description and in the drawings as well as in the claims, wherein the individual features can each be realized singly or severally in the form of sub-combinations in one embodiment of the invention and in other fields, and can represent embodiments advantageous and protectable per se, for which protection is claimed here. The subdivision of the application into individual sections and sub-headings does not limit the statements made thereunder in their general validity.

BRIEF DESCRIPTION OF THE DRAWINGS

Further advantages and aspects of the invention are revealed by the claims and the description of exemplary embodiments of the invention, which are explained below with reference to the FIGURE. FIG. 1 shows a schematic representation of a washing machine according to the invention.

DETAILED DESCRIPTION OF THE EXEMPLARY EMBODIMENTS

FIG. 1 is a greatly simplified representation of a washing machine 11 according to the invention with a housing 12. The washing machine 11 has a rotatable drum 14 with an axis of rotation 15 which is arranged within a drum-receiving container 17. The washing machine 11 has a water inlet WE and a water outlet WA. A water routing system has a plurality of water lines 1 in the interior of the washing machine 11, in which five valves V1 to V5 are also arranged. A water line leads from valve V1 to a spray nozzle 16 within the drum-receiving container 17 or within the drum 14 for introducing or spraying water into the drum 14. A container drain 22 on a water line 12 as a drain line 23 leads to a valve V3 which is connected to a filter 27. The water inlet WE is connected to the filter 27 by way of a valve V3. By way of a further water line, the filter 27 is connected to a pump 25 which in turn is connected by way of a water line to the valve V1. A dispensing means 29 introduces substances providing a washing action into the water line between filter 27 and pump 25 by way of a valve V4. This is known from the prior art and need not be explained further; the apportioning of substances providing a washing action is not the subject matter of the present invention. In addition to its filtering function, the filter 27 may also serve as a volume of water for recirculating water from the drum 14 or from the drum-receiving container 17.

At the top of the drum-receiving container 17, there is a top air inlet 24 which leads by way of a water line 11 and an air inlet valve V5 to two nonreturn valves D1 and D2. The nonreturn valve D1 allows water, air and suds to pass in a direction away from the drum 14 or drum-receiving container 17, but not in the opposite direction. A corresponding water line leads to the water outlet WA. The nonreturn valve D2 allows air to pass through in the direction of the drum-receiving container 17, in particular for pressure equalization or venting. This air is drawn in through an air inlet LE which opens into the interior of the washing machine 11. Since the machine's housing 12 is obviously not airtight, air may accordingly be drawn in from the outside. Air, water or suds cannot emerge in the opposite direction due to the nonreturn function. The two nonreturn valves D1 and D2 here operate in opposite directions, i.e. with opposing conducting directions. In this way, pressure can be equalized in the drum-receiving container 17 and furthermore upwardly emerging suds can be evacuated through the nonreturn valve D1 to the water outlet WA. The air inlet valve V5 may be used to close the top air inlet 24, in particular to close it overall in airtight manner. If the air inlet valve V5 is opened, the two nonreturn valves D1 and D2 can operate in opposite directions. A flow cross-sectional area of the nonreturn valve D1 is greater than a flow cross-sectional area of the nonreturn valve D2. In this way, it is in particular possible for voluminous suds to be better evacuated through nonreturn valve D1, while actually only air has to be able to gain access to the system through nonreturn valve D2.

A controller 31 is connected to the pump 25, the dispensing means 29 and the valve V4 and, in a manner which is not shown, also to the other valves for controlling them. The controller 31 can also be connected to an operating means (not shown) for the washing machine and optionally to inverter electronics for a drum drive motor.

During the washing process, the drum 14 rotates and washing liquor, i.e. water combined with substances providing a washing action, is sprayed into the drum 14 via the spray nozzle 16. The composition of the washing liquor can be set by the controller 31 via the dispensing means 29. At the valve V1, it is possible to set whether the washing liquor is introduced into the drum 14 or pumped out of the washing 11 via the water outlet WA. The valve V2 makes it possible to shut off water flow from the drum 14 via the container drain 22 back into the filter 27 and thus back into the circuit.

The nonreturn valve D1 serves to prevent air, water or suds from escaping from the drum 14 or from the drum-receiving container 17 to the outside via the top air inlet 24, the line 11 and the valve V5 if there is excess pressure or too many suds in the drum 14 or in the drum-receiving container 17. This excess of suds can make it necessary to stop the washing process until the suds slowly break down or collapse. Operating the pump 25 with too many suds in the circuit is not possible or at least highly problematic. Air, water or suds can also be discharged to the water outlet WA. The nonreturn valve D2 is shut off in this case. This is because nonreturn valve D2 which operates in the opposite direction allows air into the drum-receiving container 17 or into the drum 14. In this way, a reduced pressure therein can be equalized. Air, water or suds cannot, however, emerge here. If suds are formed during the washing process, for example due to incorrect dispensing of laundry detergents, an excessive rotational speed or possibly too small a volume of laundry in the drum 14, i.e. due to excessively intense mechanical laundering action caused on the one hand by excessively high rotational speed of the drum 14 and/or on the other hand by too small a laundry load, the suds can escape to the outside via the line 11 through the nonreturn valve D1 when the air-inlet valve V5 is open. In particular, the suds escape into the water line to the water outlet WA. The valve V2 can assist this process by being closed or by air flow being controlled as a function of a volume of laundry in the drum 14, a rotational speed of the drum 14 and the volume of water present in the system.

The top air inlet 24 is configured so as to facilitate outflow of suds. Flow areas at the bottom of the drum-receiving container 17 may thus be smaller in total than in the upper region or at the top air inlet 24. The flow of water or air may additionally be controlled via the valves V2 and V5.

In order to achieve a stable state, fresh water can be supplied from outside at the water inlet WE via the valve V3. Some of the washing liquor can also alternately be removed from the system through the water outlet WA via valves V2 and V1 by way of the pump. The concentration of laundry detergents in the water in the system can also be adjusted in this manner. In parallel, the rotational speed of the drum 14 can be reduced and the pump 25 can be used exclusively for pumping away suds or washing liquor.

Once the suds have been sufficiently reduced, air exchange may again be achieved via the nonreturn valve D2 alone. At this point, nothing needs to escape from the drum-receiving container 17 through the nonreturn valve D1.

The invention claimed is:

1. A washing machine comprising:

a drum for washing laundry therein, a drum-receiving container in which said drum is arranged rotatably about an axis of rotation, a water routing system comprising:

a water inlet from an external water supply into said washing machine, water lines and valves, a water outlet from said washing machine, an input device for water into said drum, at least one container drain at said bottom of said drum-receiving container, and a pump which is connected by way of water lines to said container outlet and to said input device, and a washing machine controller to which said pump is connected, wherein a valve is arranged at said container drain on said drum-receiving container, which valve seals said drum-receiving container in a watertight and airtight manner, an air inlet is arranged in said upper region of said drum-receiving container, said air inlet being closable in airtight manner by way of an air inlet valve, and at least one nonreturn valve is also provided at an upper region of said drum-receiving container, wherein said nonreturn valve allows suds to pass therethrough out of said drum-receiving container.

2. The washing machine as claimed in claim 1, wherein;

said at least one container drain comprises a plurality of container drains, and said air inlet in said upper region of said drum-receiving container has a cross-section which is greater than or equal to a sum of all cross-sections of said plurality of container drains at said bottom of said drum-receiving container.

3. The washing machine as claimed in claim 1, wherein said air inlet is arranged in an upper third of said drum-receiving container.

4. The washing machine as claimed in claim 3, wherein said air inlet is at an uppermost point of said drum-receiving container.

5. The washing machine as claimed in claim 1, wherein said nonreturn valve is provided at said air inlet.

6. The washing machine as claimed in claim 1, wherein said nonreturn valve allows the suds to pass therethrough out of said drum-receiving container and to said water outlet.

7. The washing machine as claimed in claim 1, wherein at least one further nonreturn valve is provided at an upper region of said drum-receiving container, wherein said further nonreturn valve allows air to pass therethrough into said drum-receiving container.

8. The washing machine as claimed in claim 7, wherein precisely two oppositely arranged nonreturn valves are provided in said upper region of said drum-receiving container.

9. The washing machine as claimed in claim 7, wherein a flow cross-sectional area of said two nonreturn valves is different.

10. The washing machine as claimed in claim 9, wherein a flow cross-sectional area of one of said nonreturn valves with a conducting direction out of said drum-receiving container is greater than a flow cross-sectional area of one said nonreturn valves with a conducting direction into said drum-receiving container.

11. A method for operating said washing machine as claimed in claim 1, wherein a valve at said at least one container drain out of said drum-receiving container is opened for pumping water out of said drum-receiving container, wherein, in addition, said air inlet valve in said upper region of said drum-receiving container is also opened.

12. A method for operating said washing machine as claimed in claim 1, wherein a valve at said at least one container drain is at least 50% closed in order to reduce suds in said drum.

13. The method as claimed in claim 12, wherein said valve at said container drain is entirely closed in order to reduce said suds in said drum.

* * * * *